US008408413B2

(12) United States Patent
Przytulla

(10) Patent No.: US 8,408,413 B2
(45) Date of Patent: Apr. 2, 2013

(54) PALLET CONTAINER

(75) Inventor: Dietmar Przytulla, Kerpen (DE)

(73) Assignee: Mauser Werke GmbH & Co. KG, Bruehl (DE)

( * ) Notice: Subject to any disclaimer, the term of this patent is extended or adjusted under 35 U.S.C. 154(b) by 2084 days.

(21) Appl. No.: 11/157,737

(22) Filed: Jun. 21, 2005

(65) Prior Publication Data

US 2005/0247710 A1 Nov. 10, 2005

Related U.S. Application Data

(63) Continuation of application No. PCT/EP2004/003975, filed on Apr. 15, 2004.

(30) Foreign Application Priority Data

Apr. 25, 2003 (DE) ..... 203 06 550 U

(51) Int. Cl.
*B65D 77/06* (2006.01)

(52) U.S. Cl. ..... 220/23.91; 220/1.6; 220/23.87; 206/386

(58) Field of Classification Search ..... 220/23.91, 220/1.5, 1.6, 23.87, 23.89, 495.05; 206/386
See application file for complete search history.

(56) References Cited

U.S. PATENT DOCUMENTS

| | | | | |
|---|---|---|---|---|
| 5,678,688 | A | 10/1997 | Schutz | |
| 6,244,453 | B1 | 6/2001 | Maschio | |
| 7,140,490 | B2 * | 11/2006 | Przytulla | 206/386 |

FOREIGN PATENT DOCUMENTS

| | | |
|---|---|---|
| DE | 297 19 830 | 6/1998 |
| EP | 0 755 863 | 9/1997 |
| EP | 0 734 967 | 5/1999 |
| EP | 0 916 592 | 5/1999 |
| WO | WO 01/89954 | 11/2001 |

* cited by examiner

*Primary Examiner* — Stephen Castellano
(74) *Attorney, Agent, or Firm* — Henry M. Feiereisen LLC

(57) ABSTRACT

A pallet container includes a bottom pallet and a thin-walled inner container, made of thermoplastic material and resting on the bottom plate, for storing and transporting liquid or free-flowing goods. Closely surrounding the plastic container is a lattice tube frame which includes vertical and horizontal tubular rods welded to one another and which is securely fixed to the bottom plate. In order to improve the lattice tube frame durability while maintaining sufficient stacking load-bearing capacity, at least the vertical tubular rods have regions of low tubular profile height and high tubular profile height, wherein the regions of low tubular profile height are uniformly linear and positioned outside the intersections, and the regions of high tubular profile height are positioned in an area of the intersections.

5 Claims, 15 Drawing Sheets

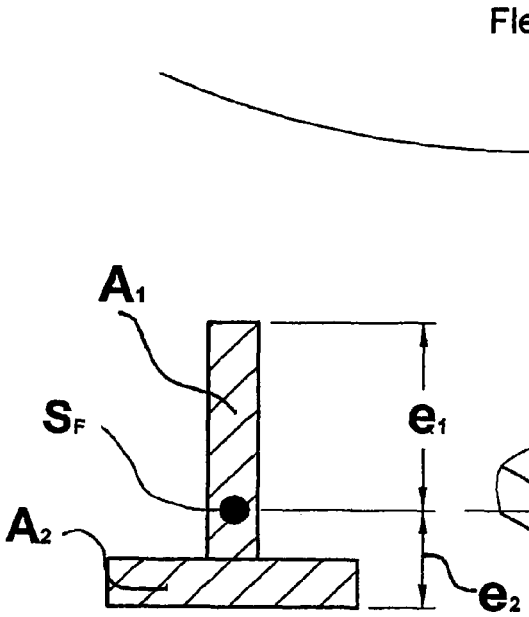
Fig 8 a
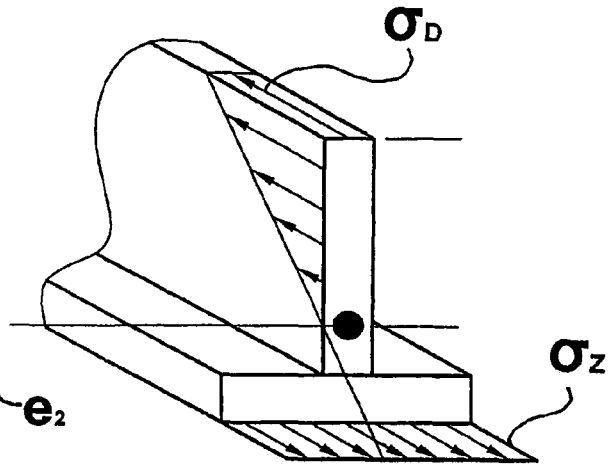
Fig 8 b
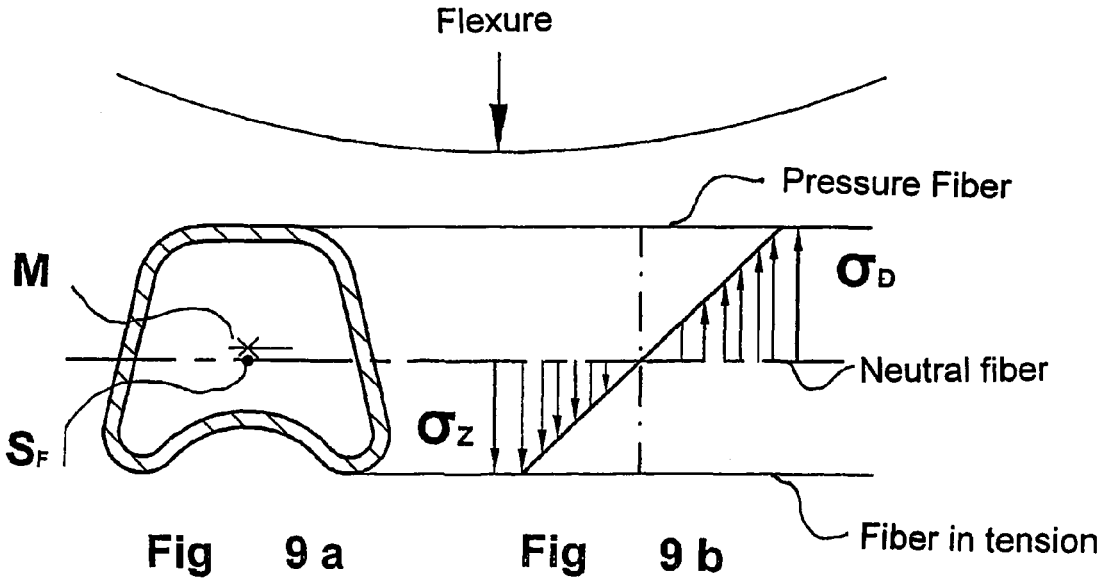
Fig 9 a
Fig 9 b

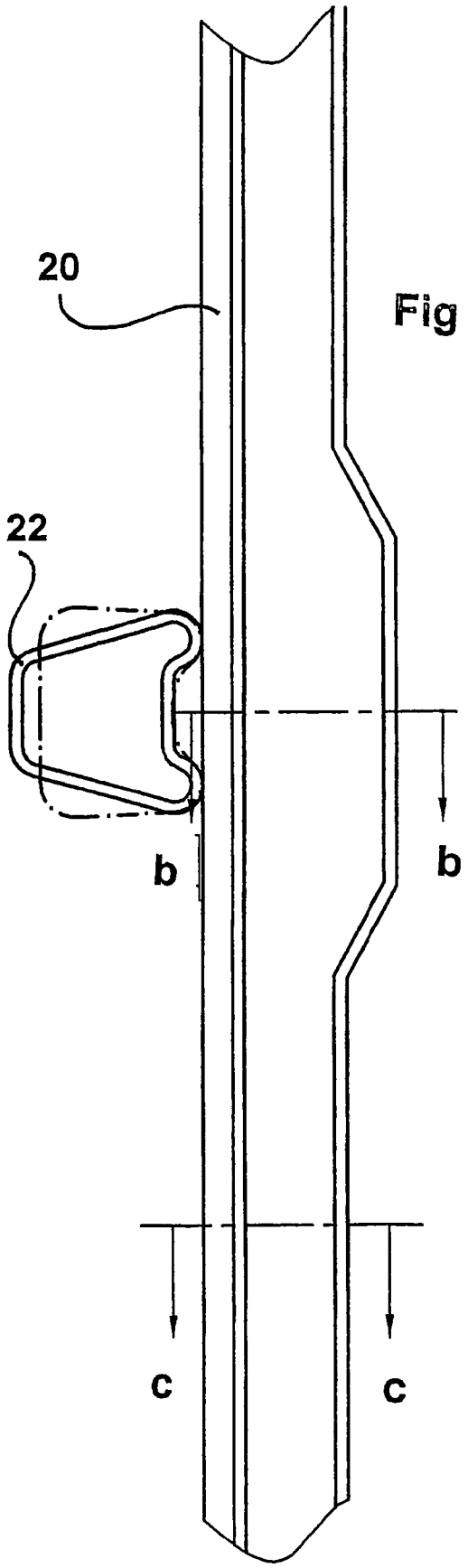
Fig 17 a
Fig 17 b
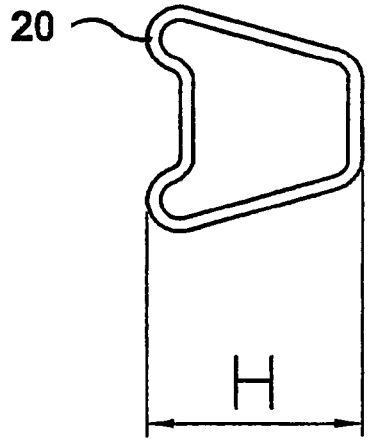
Fig 17 c
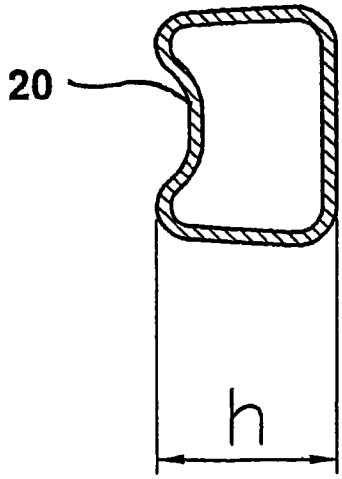

PALLET CONTAINER

CROSS-REFERENCES TO RELATED APPLICATIONS

This application is a continuation of prior filed copending PCT International application no. PCT/EP2004/003975, filed Apr. 15, 2004, which designated the United States and on which priority is claimed under 35 U.S.C. §120, and which claims the priority of German Patent Application, Serial No. 203 06 550.6, filed Apr. 25, 2003, pursuant to 35 U.S.C. 119(a)-(d), the subject matter of both are incorporated herein by reference.

BACKGROUND OF THE INVENTION

The present invention relates, in general, to a pallet container.

An example of a pallet container of a type involved here has a thin-walled inner container of thermoplastic material for storage and transport of liquid or free-flowing goods. The plastic container is closely surrounded by a lattice tube frame as support jacket, and rests on a bottom pallet to which the support jacket is fixedly secured. The lattice tube frame includes vertical and horizontal tubular rods which are welded to one another at intersecting areas.

Pallet containers are used for the storage and transport of liquid or free-flowing goods. During transport of filled pallet containers—in particular with contents of high specific weight (e.g. above 1.6 g/cm$^3$)—on poor roads with trucks with firm suspension, during transport on railway or ships, the lattice rod frame is exposed to significant stress as a result of surge forces of the goods. These dynamic transport loads generate significant continuously changing bending stress and torsion stress in the lattice tube frame, ultimately leading to fatigue cracks and resultant rod facture when exposed over respectively long periods.

Lattice tube frames with uniformly continuous lattice tube profile, are known, e.g., in European Pat. Appl. No. EP 0 755 863-A, German utility model no. DE 297 19 830-A, or U.S. Pat. No. 6,244,453 B1. As a consequence of oscillating surge pressure of the liquid content that is caused by fluctuating bending stress during transport, known lattice tube frames fracture in a relatively very short period in the tension zone of the tubular lattice rods. Rod fracture takes place predominantly in proximity of the welded intersections of the tubular lattice rods.

Those lattice tube frames with welded round rods, e.g. disclosed in European Pat. Appl. No. EP 0 734 967 B1, and with significantly reduced tube cross sectional height in the area of the intersections (no continuous tubular profile, dents or reduced tube cross sectional height of same depth) suffer the critical drawback that significant stress peaks are encountered in these areas of reduced tube cross section to thereby form break zones or buckling zones, e.g. during drop tests, when exposed to fluctuating bending stress as a result of transport loads, and during hydraulic internal pressure test. The rod areas between the intersections are much too rigid and stiff when exposed to any dynamic loads and they are unable to absorb deformations which occur only in the intersection area with the decreased tube cross sections. In addition, further quality deterioration or relief areas are necessarily provided in all horizontal and vertical lattice rods at all welding locations, e.g. in afore-mentioned European Pat. Appl. No. EP 0 734 967 B1, to protect them from tearing open/detachment during fluctuating bending stress as a result of transport loads. However, it is considered highly disadvantageous that the weakest tube cross sections are arranged in immediate proximity of the welding spots of the intersecting lattice rods so that the deformation changes continuously directly adjacent to the welding spots. As a consequence, the welding spots are overly stressed and tend to tear off. When it comes to design, the welding expert is aware not to weld dynamically stressed components in those regions that are exposed to the greatest dynamic deformation.

International PCT publication nos. WO 01/89954-A and WO 01/89955-A disclose a pallet container with a trapezoidal tube profile of the lattice rods, wherein the vertical and/or horizontal tubular rods have each a dimple laterally adjacent to an intersection. These partial dimples serve as "bending hinge" and decrease the resistance moment against bending. It has been shown that these limited dimples lead to appreciable longer service life but are unable to completely eliminate a rod fracture when an area is exposed to concentrated stress peaks over a longer period.

Lattice rod frames known to date with uniformly continuous lattice tube profile have all the drawback that the horizontal and vertical tubular lattice rods are generally too rigid and torsionally stiff along their entire length when exposed to fluctuating bending stress; As a consequence, fatigue cracks and rod fracture are encountered already after a comparably short time under stress, in particular in proximity of the welded intersections of the tubular lattice rods.

Known lattice tube frames of welded rounded tubes with reduced tube cross section at the intersections and additional partial lateral relief zones have the following drawbacks:

- The height of the reduced tube cross sections must be the same for all welded intersections, it should not be suited to different fluctuating bending stress.
- The round tubes with circular cross section next to the intersections welded in dents are very rigid, they do not deform when exposed to fluctuating bending stress.
- The round tubes adjacent to the welded intersections are furthermore very torsionally stiff, they do not deform when exposed to torsional stress. The horizontal lattice profile rods are twisted by radial movements of the vertical rods with which they are welded, when exposed to fluctuating bending stress. As a consequence, added tension stress and pressure loads act upon the welding spots.
- All loads or stress during transport such as, e.g., pressure stress, tension stress, torsional stress, can be absorbed solely by the locally limited partial dimples (desired buckling zones or fracture zones) directly adjacent the intersections.

It would therefore be desirable and advantageous to provide an improved pallet container with a lattice tube frame of welded tubular rods, to obviate prior art shortcomings so as to be resistant to fatigue cracks and rod fracture over a long period, while taking into account the stacking load of a loaded stacked pallet container (double stacking) besides the normal transport stress of back and forth sloshing liquid content.

SUMMARY OF THE INVENTION

According to one aspect of the present invention, a pallet container includes a bottom pallet, an inner container of thermoplastic material, placed on the bottom pallet, for storage and transport of liquid or free-flowing goods, and a lattice tube frame fixedly secured to the bottom plate and disposed in surrounding relationship to the plastic container to form a support jacket, said lattice tube frame including vertical and horizontal tubular rods welded to one another at intersections, wherein at least the vertical tubular rods have regions of low tubular profile height and high tubular profile height, wherein the regions of low tubular profile height are uniformly linear and positioned outside the intersections, and the regions of high tubular profile height are positioned in an area of the intersections.

The present invention resolves prior art problems by providing at least the vertical tubular rods with a high tubular profile height at the intersections to therefore form limited areas of high rigidity and torsional stiffness, while the lattice rods situated outside an intersection have a low tubular profile height to form areas of lower rigidity and torsional stiffness.

According to another feature of the present invention, the vertical tubular rods may hereby be configured with two alternating cross sections of different configuration, with a first cross section having a tubular profile height and a resistance moment against bending along a first rod length, and a second cross section having a tubular profile height which at least partially exceeds the tubular profile height of the first cross section and has, along a second rod length which extends across the area of the intersections and is shorter than the first rod length, a resistance moment against bending which is greater than the resistance moment against bending of the first cross section.

According to another feature of the present invention, the areas of low tubular profile height may extend in midsection between two intersections, and the areas of high tubular profile height may be constructed in midsection across each intersection. Thus, the area of the welded intersections is effectively protected against fatigue cracks and rod fracture, i.e. not by a local desired fracture point directly next to the welding spots with rigid zones between the intersections but by the entire area between the welded intersections which is configured as more elastic, flexible zone.

As the pallet containers have a longer and a shorter side (dimensions 1200×1000 mm), the greatest dynamic deformations are naturally encountered in the longer sidewalls of the tubular lattice type support jacket where typically most fractures of the tubular rods occur. As a consequence of the configuration of the tubular rods in accordance with the invention in which the areas of reduced tubular profile height—as viewed in longitudinal direction of the tubular rod—are significantly longer than the areas with higher tubular profile height of higher resistance moment against bending (at least twice as long), the longer sidewall in particular of the tubular lattice type support jacket defines a vibration unit which is so elastically adjusted, while maintaining a sufficient stiffness against stacking loads, that tubular rod fractures are no longer experienced even when exposed to transport shocks over an extended period.

Damaging fluctuating bending stress and torsional loads encountered during normal transport and additional double stacking (superimposed additive pressure load) are absorbed by the entire elastic areas between the rigid intersections so that the occurrence of locally excessive stress peaks is no longer experienced on or adjacent to the welded intersections.

Furthermore, the tubular lattice rod according to the invention is constructed torsionally softer in the long areas with smaller tubular profile height outside the intersections, i.e. it allows more twist or generates less pressure stress and tension stress on the welded intersection at same twist angle.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 8*a* is a cross sectional view of a T-beam model with associated stress distribution during flexure;

FIG. 8*b* is a perspective view of the T-beam model with associated stress distribution during flexure;

FIG. 9*a* is a sectional view of a trapezoidal rod profile;

FIG. 9*b* is a schematic illustration of the associated stress distribution during flexure of the trapezoidal rod profile;

FIG. 17*a* is a longitudinal section of tubular lattice rods at a welded intersection (great tubular profile height);

FIG. 17*b* is a cross section of a vertical tubular lattice rod at a welded intersection (great tubular profile height);

FIG. 17*c* is a cross section of a vertical tubular lattice rod (small tubular profile height);

DETAILED DESCRIPTION OF PREFERRED EMBODIMENTS

Figure 1:
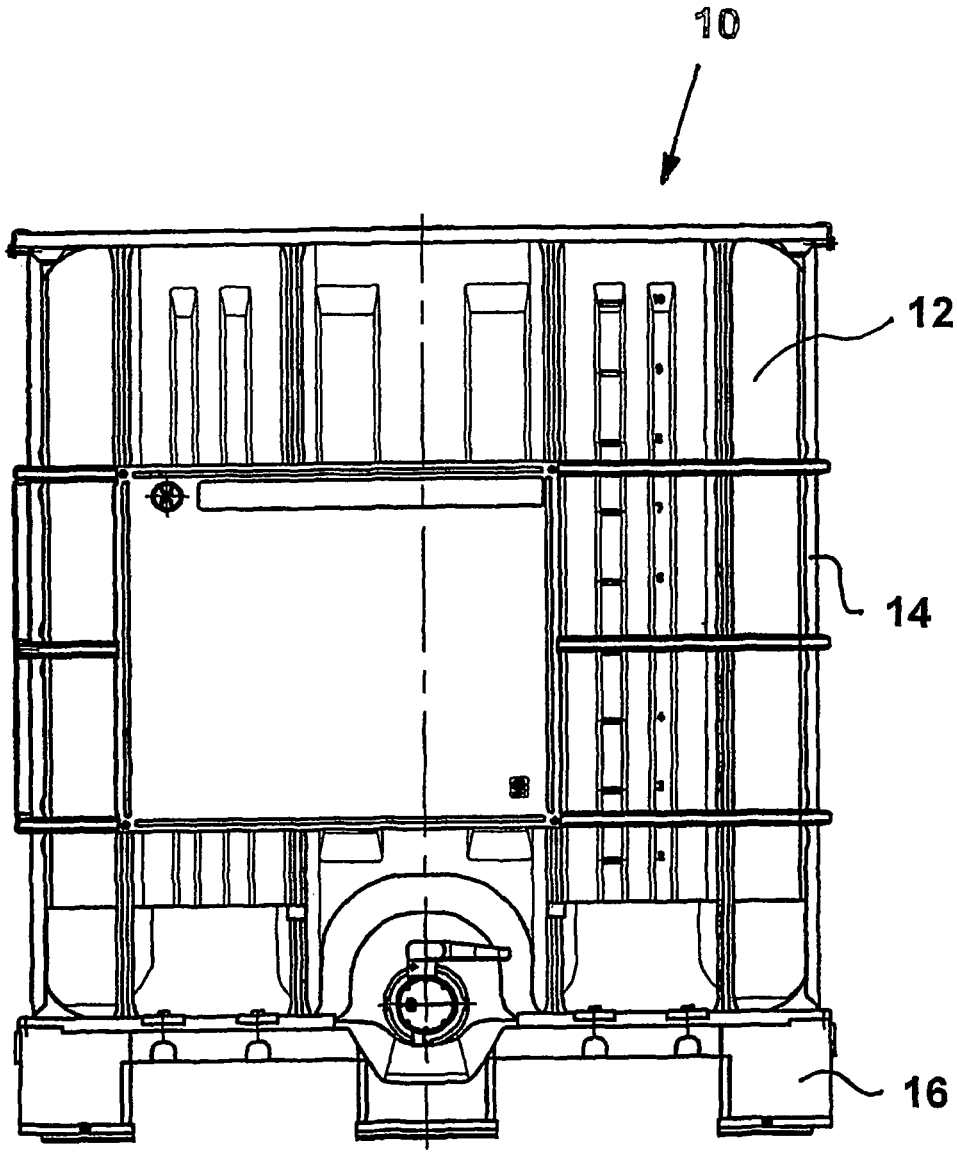
FIG. 1 is a front view of a pallet container according to the invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
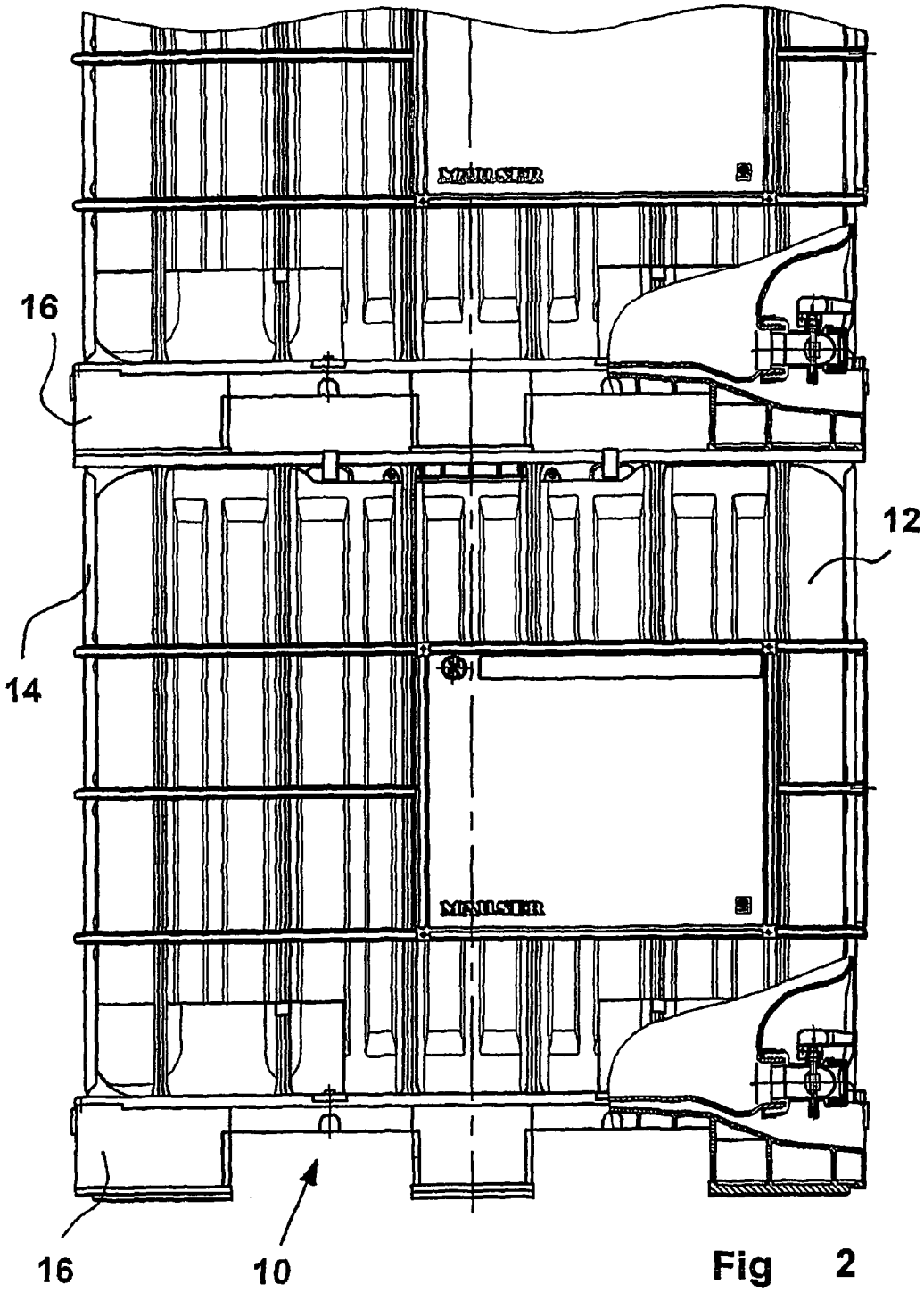
FIG. 2 is a side view of the pallet container of FIG. 1, with illustration a stacked second pallet container (double stacking)

Turning now to the drawing, and in particular to FIG. 1, there is shown a front view of a pallet container according to the invention, generally designated by reference numeral 10 and including an inner plastic container 12, a lattice tube type support jacket 14, and a bottom pallet 16 with lower discharge fittings. The pallet width may be 1000 mm. As shown in FIG. 2 by way of a side view, the pallet container 10 may have a pallet length of 1200 mm, with a second identical pallet container being stacked. The lower pallet container 10 is hereby subjected during transport, e.g. on a truck, in addition to the fluctuating surge pressure loads of the liquid content, in a significant and superimposing manner also to the stacking load of the stacked pallet container (double stacking) which swings up and down as well as back and forth.

Figure 3A:
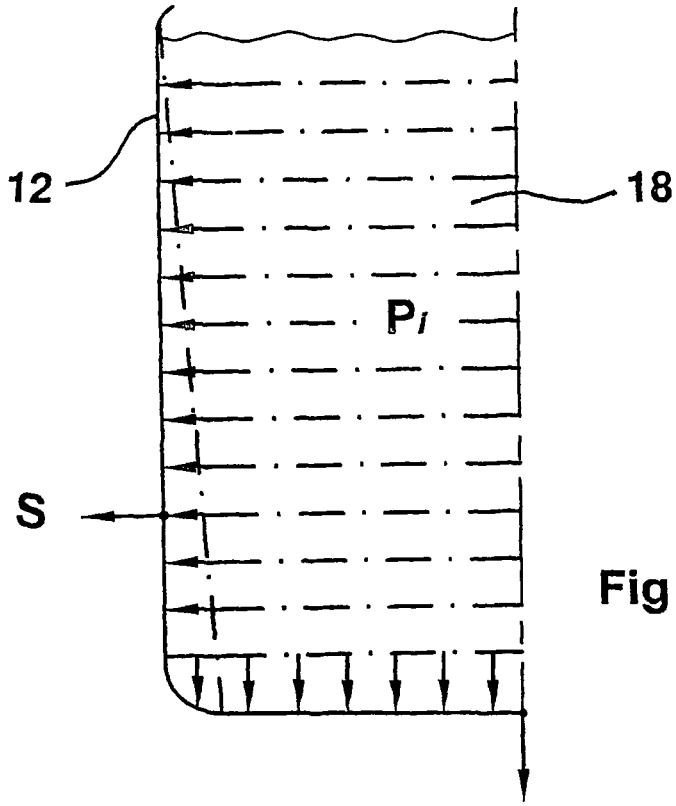
FIG. 3*a* is a schematic illustration of a hydrostatic pressure distribution in the plastic container.
Figure 3B:
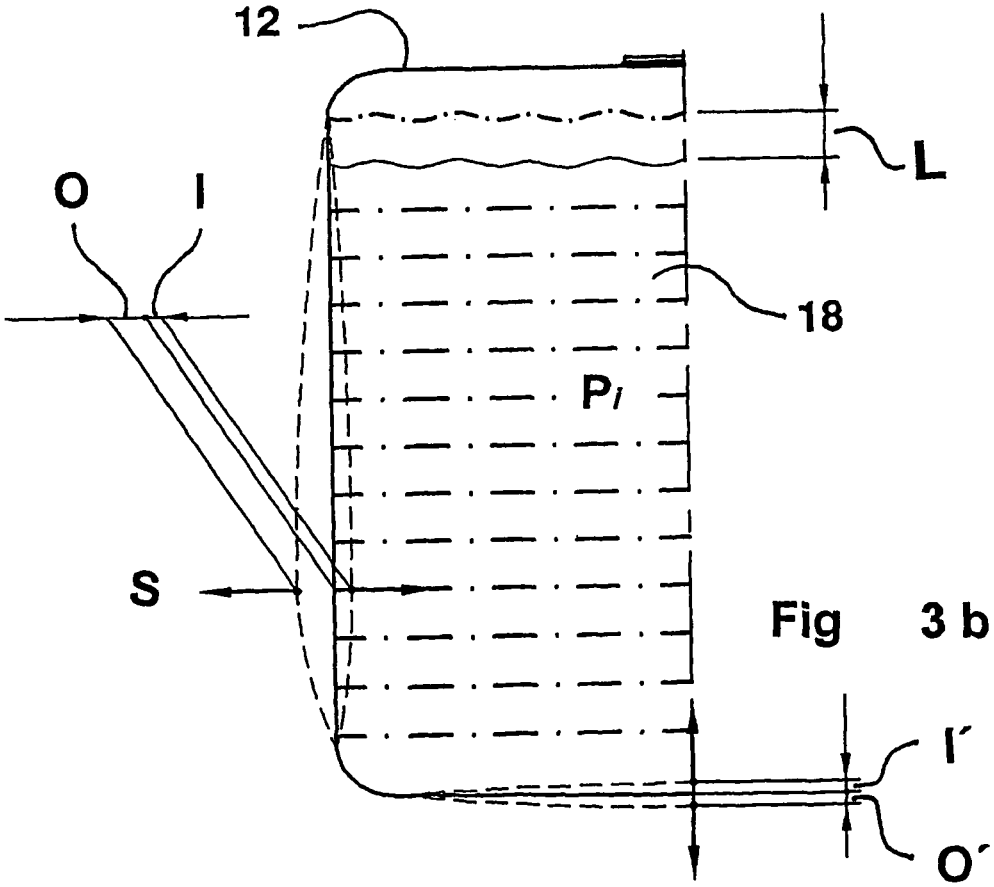
FIG. 3*b* is a schematic illustration of the plastic container, depicting a bulging of the sidewall of the plastic container.

When the inner plastic container 12 is filled with liquid content 18, the course of the internal hydrostatic pressure Pi increases from top to bottom, as shown in FIG. 3*a*, wherein the mass center of gravity S of the liquid content is approximately at one third of the height of the inner container. As a consequence, the inner container 12 undergoes a changing bulging when exposed to dynamic transport loads, as illustrated in FIG. 3*b*, with the lateral bulging being at a maximum exactly at a level of the mass center of gravity S. During dynamic vibrations of the system, the inner container "pumps", whereby the fill height of the liquid content changes by the height L (level) while the sidewall deforms elastically to the outside and inside by the amount "O" (outside) and "I" (inner side) about the normal position, and the bottom plate (up and down swinging) correspondingly deforms elastically to the outside and inside in midsection by an amount "O" and "I" (more pronounced in the subjacent pallet container).

Figure 4:
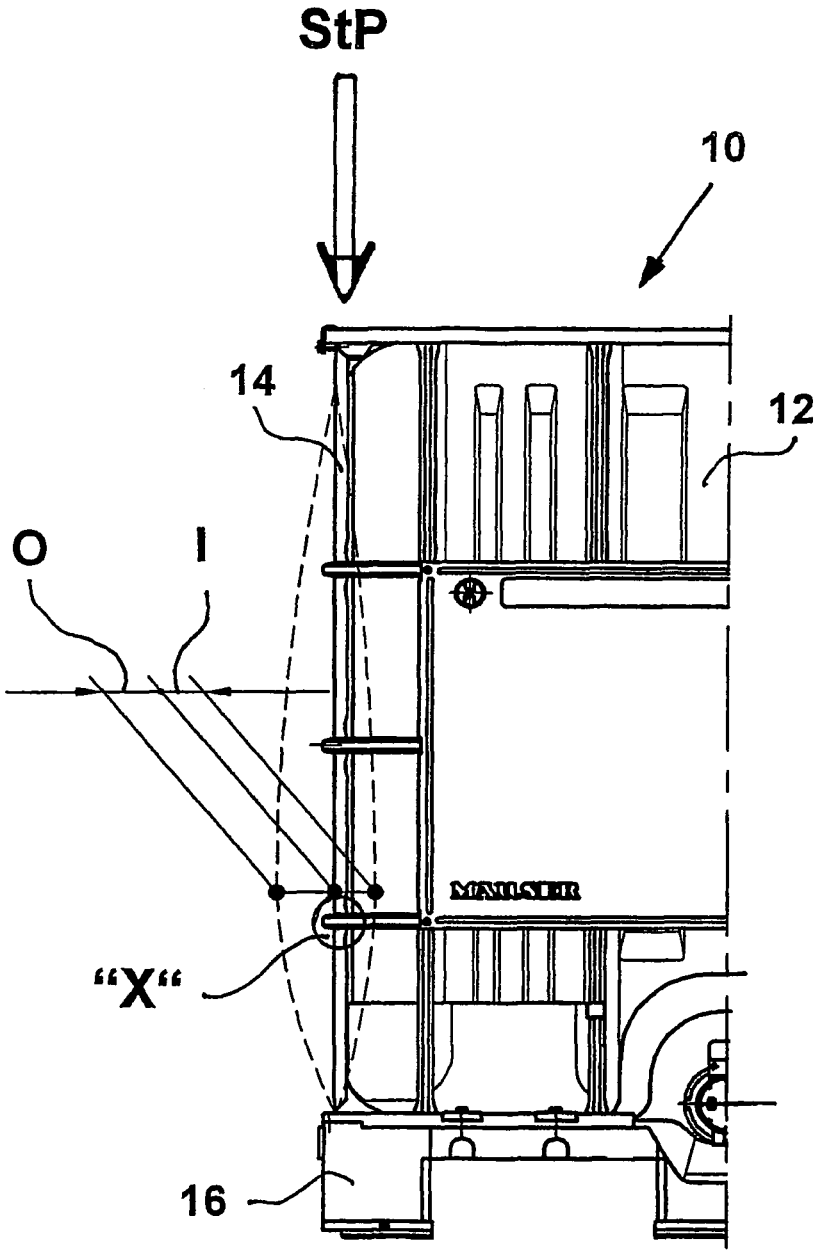
FIG. 4 is a front view of a left side of the pallet container, depicting deformations of the pallet container by surge forces with superposed stacking load.

FIG. 4 is a front view of a left side of the pallet container 10 and shows this vibration state with added stacking load "StP" for a long sidewall of the pallet container 10, wherein the tubular rods of the lattice cage necessarily follow these elastic deformations to the outside and to the inside.

Figure 5:
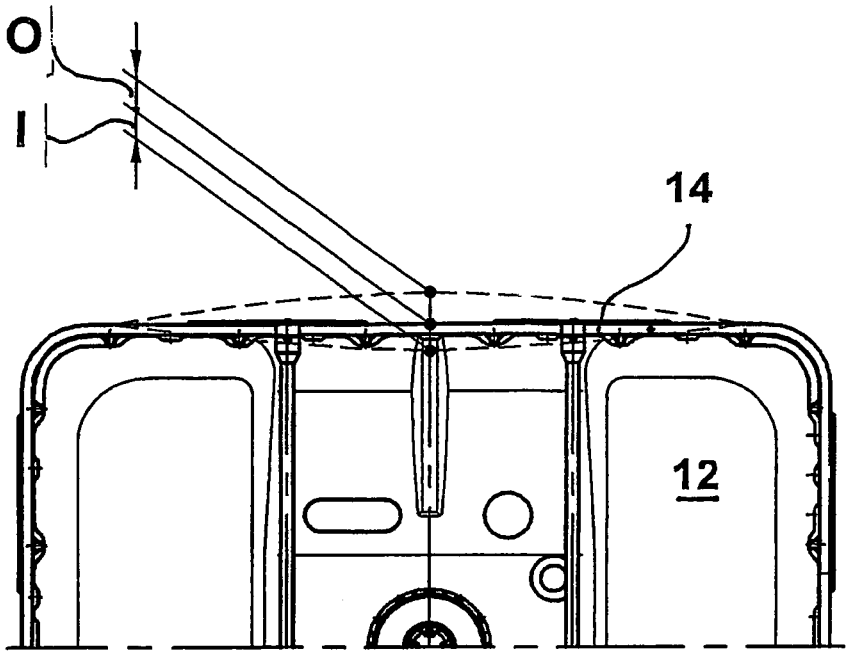
FIG. 5 is a fragmentary plan view of the pallet container, depicting deformations of the pallet container by surge forces and stacking load.

FIG. 5 shows a plan view of the long sidewall of the pallet container 10. It is clear that the deformation of the sidewall to the outside is about twice as large as the compression of the sidewall to the inside.

When considering load conditions, the weakest spot or the area that is under stress the most must be taken into account. Both vertical rods in the middle of the long sidewalls of the lattice cage in the area of greatest bulging are also exposed to the greatest stress because these vertical rods are adversely affected the most by the impact of the stacking load "StP" of the stacked further pallet container. Damages that occur predominantly at these vertical rods involve buckling or fracture below the lower horizontal rod and tear-off of the welded connections with the uppermost circumferential horizontal rod. The stacked pallet container (FIG. 2) also represents its own independent vibration system during transport shocks. The bottom pallet rests on the outer side circumferentially upon the lattice frame or upon the uppermost horizontal lattice rod of the subjacent pallet container and vibrates hereby—also in midsection of the long sidewall—predominantly downwards and greatly strains additionally (like hammer shocks) the middle vertical rods of the subjacent pallet container.

Figures 6A, 6B, 6C:
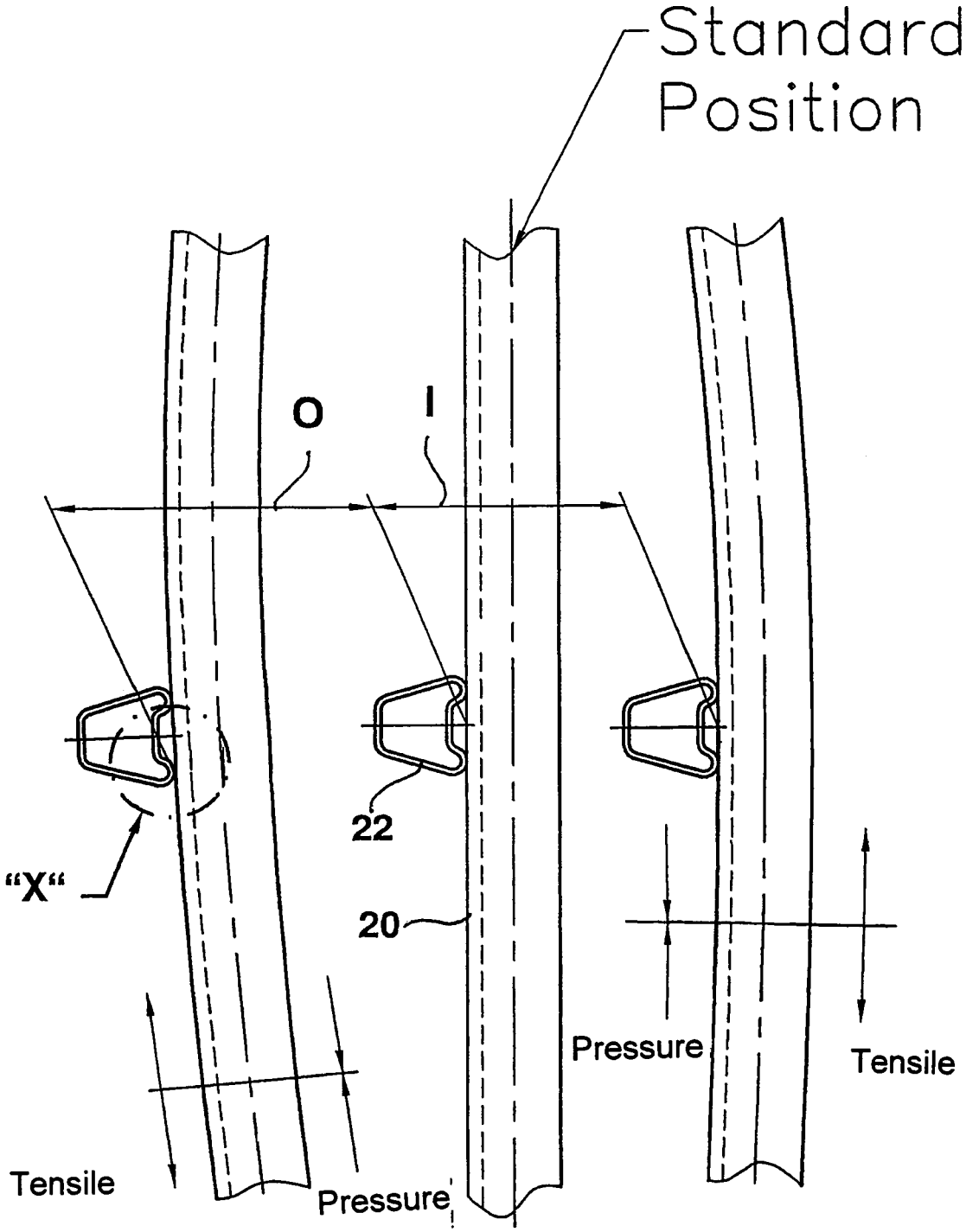
FIG. 6*a* is a fragmentary schematic sectional view of the pallet container to show a normal lateral deformation of a vertical lattice rod.
FIG. 6*b* is a fragmentary schematic sectional view of the pallet container to show a flexure of a vertical lattice rod to the outside.
FIG. 6*c* is a fragmentary schematic sectional view of the pallet container to show a flexure of a vertical lattice rod to the inside.

FIGS. 6*a*, 6*b*, and 6*c* show a vertical tubular rod 20 in the area of a lower intersection "X" with a lower horizontal tubular rod 22 welded thereon. FIG. 6*a* shows the standard position (normal condition), while FIG. 6*b* illustrates the state of greatest flexure (amount "O") to the outside, and FIG. 6*b* the state of greatest flexure (amount "I") to the inside. When the vertical tubular rod 20 is bent outwards (FIG. 6*b*), the outer side of the rod 20 is exposed to high tensile stress and the inner side of the rod 20 is exposed to corresponding pressure stress. When the vertical tubular rod 20 is bent inwards (FIG. 6*c*), the outer side of the rod 20 is exposed to low pressure stress and the inner side of the rod 20 is exposed to corresponding tensile stress. These deformations take place in rapid change of about 3 Hz (vibrations/sec=about 180 hits/minute) during dynamic transport loads.

Figure 7A:
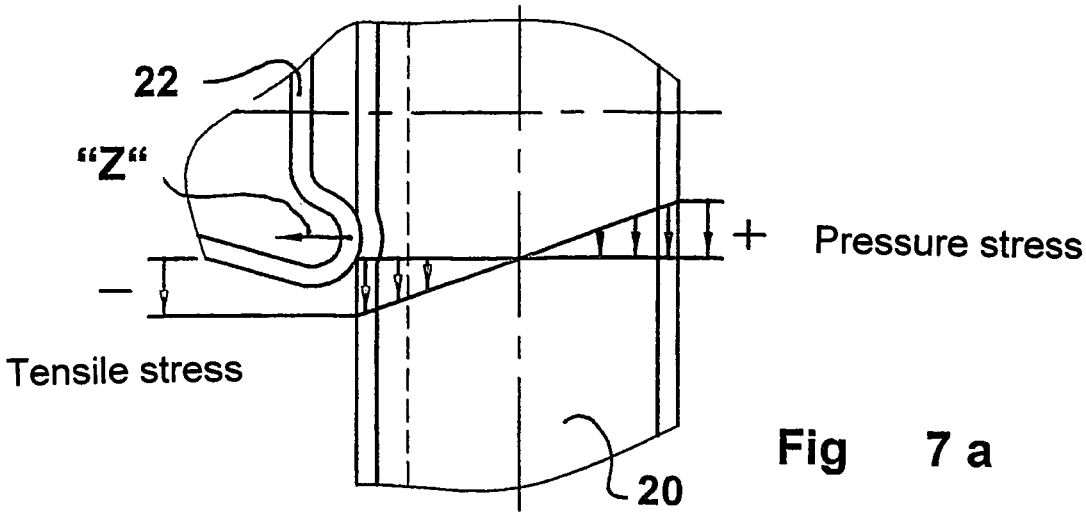
FIG. 7*a* is a schematic illustration of force considerations on a welded lattice rod intersection.
Figure 7B:
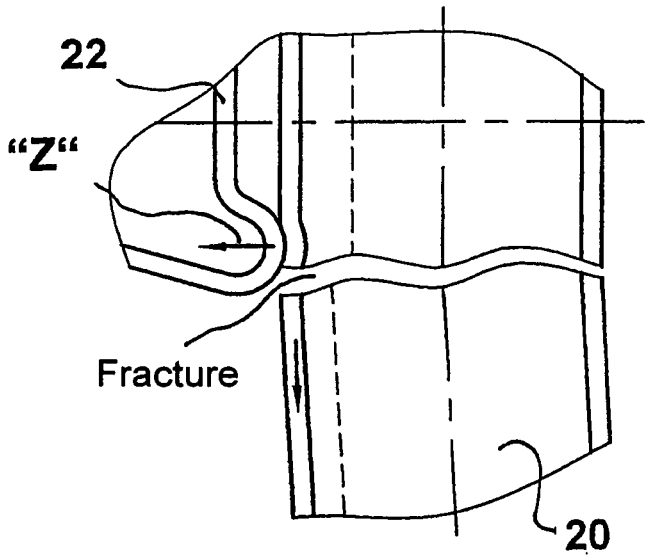
FIG. 7*b* is a schematic illustration of a crack formation as a result of bending stress at an intersection.
Figure 7C:
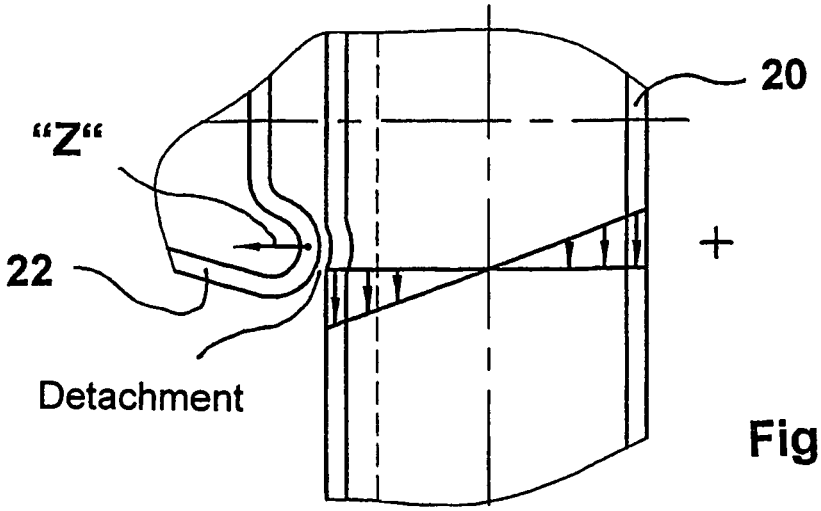
FIG. 7*c* is a schematic illustration of a tearing-off of a welding spot at an intersection.

When considering FIG. 4, it becomes clear that the vertical tubular rod 20 below the intersection "X" is flexed to a greater degree than above this intersection. The reason for this resides in the fact that the lower end of the vertical tubular rods 20 is securely fixed to the bottom pallet 16 and the distance of the intersection "X" to the bottom pallet 16 is comparably short. This results in particular load situations which are illustrated in FIGS. 7*a*, 7*b* and 7*c*. As a result of the varying flexure of the vertical rods (top, midsection and bottom; and outer side and in midsection in the long sidewall of the lattice frame), the horizontal tubular rods 22 are twisted, thereby causing torsional stress which manifests itself in the lower welding spots of the concerned intersection "X" as additional tensile stress "Z" which is additive in its effect (FIG. 7*a*). This can lead, on one hand, to fatigue crack or rod fracture (FIG. 7*b*) or to a tear-off/detachment of the welding spots, e.g. when circular tube profiles are involved (FIG. 7*c*).

For explanation of occurring tensile/pressure stresses, FIGS. 8*a* and 8*b* illustrate as models a T-beam with associated stress condition during exposure to bending stress. The neutral fiber layer (=elastic line) extends through the centroid SF of a bending beam (T-beam). When a symmetric cross section (e.g. round tube, square cross section or rectangular cross section) is involved, the neutral fiber is situated in the middle of the bending beam because it is there where the centroid lies. As illustrated in FIG. 8*a*, the centroid $S_F$ of the T-beam is shifted downwards to the broad side of the T-beam. As a result, the section modulus of the T-beam for the lower edge fibers are greater on the broad side than for the upper edge fibers on the narrow side so that the tensions are smaller at the bottom than at the top. Typically, almost any material can be exposed to a greater extend to a pressure load than to a tensile load, i.e. it can cope with higher pressure stress than with dangerous tensile stress. This is important in relation to the correct installation of a dynamically loaded component.

A vertical rod of trapezoidal profile (with broad side and narrow side) behaves in a similar. i.e. approximated manner as a T-beam, as shown in FIGS. 9*a* and 9*b*. When considering the most unfavorable load situation on a long side of the lattice frame with the greatest flexure to the outside of a vertical tubular rod in the area of the trapezoidal profile, the tensile stress on the outer broadside of the tubular rod, where the welding spots are located in the intersections, are lower than the pressure stress on the inwardly pointing narrow side of the vertical tubular rod (compare FIG. 9*b*): $\sigma_Z<\sigma_D$.

This makes it clear that the vertical tubular rod 20 is exposed in the area of the beneficial trapezoidal profile to smaller dangerous tensile stress, when critically bent to the outside (T-beam model), than would be the case with the use of a symmetric tube cross section like e.g. a round tube.

Figure 10:
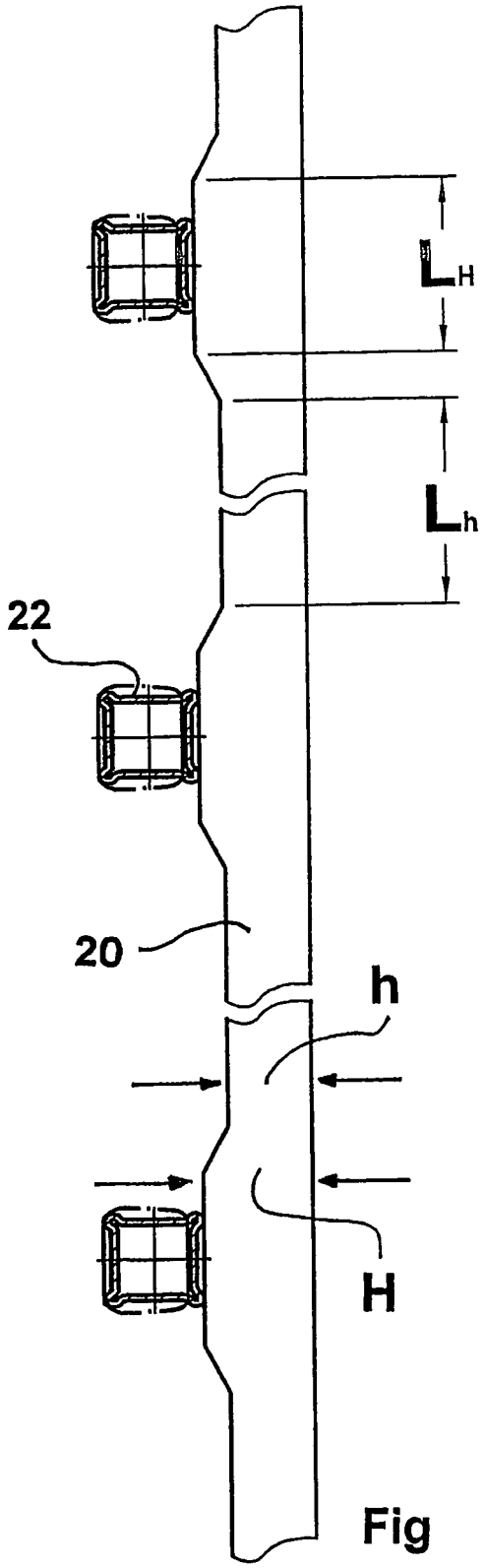
FIG. 10 is a schematic illustration of tubular lattice rods of square-rectangle profile with increased tubular profile height across the intersection.

FIG. 10 is a schematic illustration of tubular lattice rods 20, 22 of square-rectangle profile with increased tubular profile height across the intersection. The base profile of the tubular lattice rods may have an edge length of e.g. 16 mm=high rectangular profile. In the area of the intersections, the horizontal tubular rods 22 and the vertical tubular rods 20 have a great tubular profile height "H" of e.g. 16 mm, while the free areas of the tubular rods 20, 22 outside the intersections have a short rectangular profile with reduced, lower tubular profile height "h" of e.g. 12 mm. The reduction of the tubular profile height from "H" to "h" is respectively realized here from the side on which the horizontal tubular rods 22 and the vertical tubular rods 20 are welded to one another.

Figure 11:
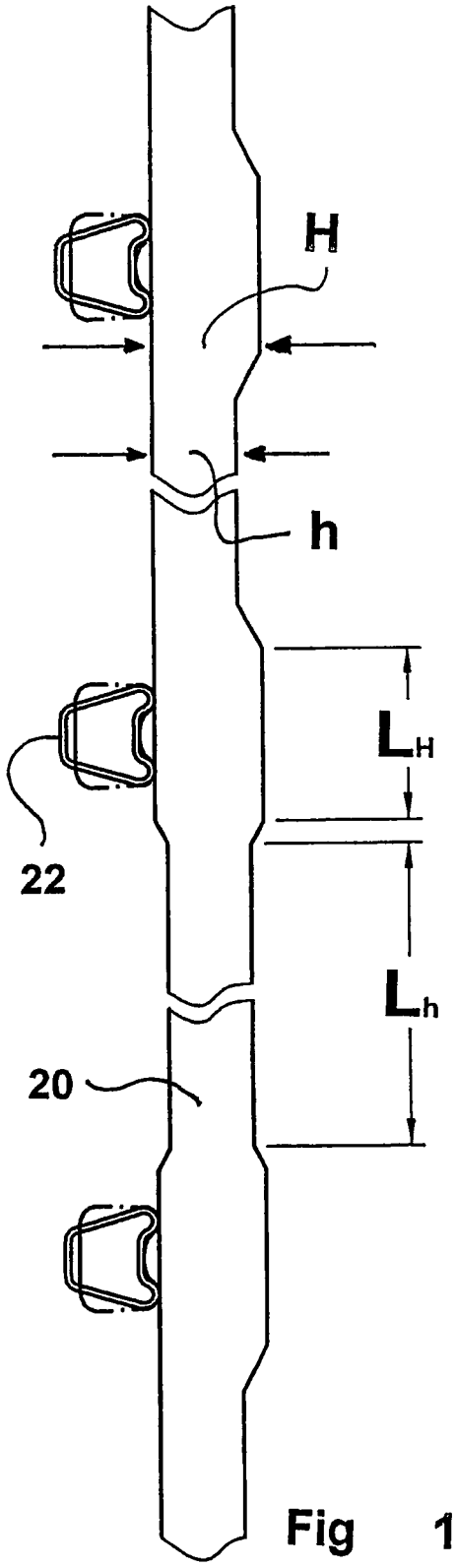
FIG. 11 is a schematic illustration of tubular lattice rods with increased tubular profile height in the intersection.

A currently preferred embodiment according to the present invention is shown in FIG. 11. The base profile of the tubular lattice rods 20, 22 is configured here as trapezoidal profile. In the area of the intersections, the horizontal tubular rods 20 and the vertical tubular rods 22 have a great tubular profile height "H" of e.g. 16 mm, while in the free areas of the tubular rods 20, 22 outside the intersections they have a reduced, lower tubular profile height "h" of about 12 mm of an approximately rectangular cross section (low rectangular profile). The reduction of the tubular profile height from "H" to "h" is realized here from the side which opposes the welding spots. This has the advantage that the sides on which the horizontal and vertical tubular rods are welded to one another, are linearly continuous and non-deformed. Thus, no substantial changes or jumps in the height of the maximum tensile stress are experienced when a vertical tubular rod is subjected to a flexure to the outside (amount "O").

The lower area of the vertical tubular rod 20 is shown here with a further advantageous constructive variant in which the reduction of the tubular profile height from "H" to "h" is respectively realized from both sides (welded side and the side opposite to the welding spots), so as to provide advantages with respect to manufacture and to prevent one-sided deformation stress. Furthermore, the reduction on both sides of the tubular rod height per side requires formation of only a small, i.e. half the height difference (H−h/2 (per side e.g. 2-3 mm) in the high base profile.

Figure 12:
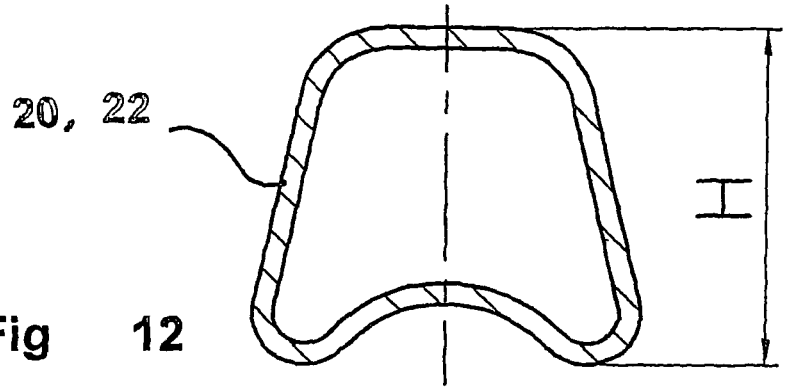
FIG. 12 is a cross section of a profiled tubular lattice rod according to the invention at an intersection (great tubular profile height)
Figure 13:
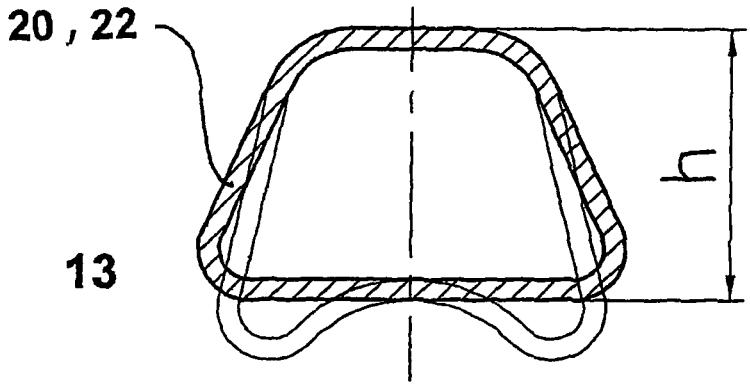
FIG. 13 is a cross section of a profiled tubular lattice rod outside the welded intersections (low tubular profile height)
Figure 14:
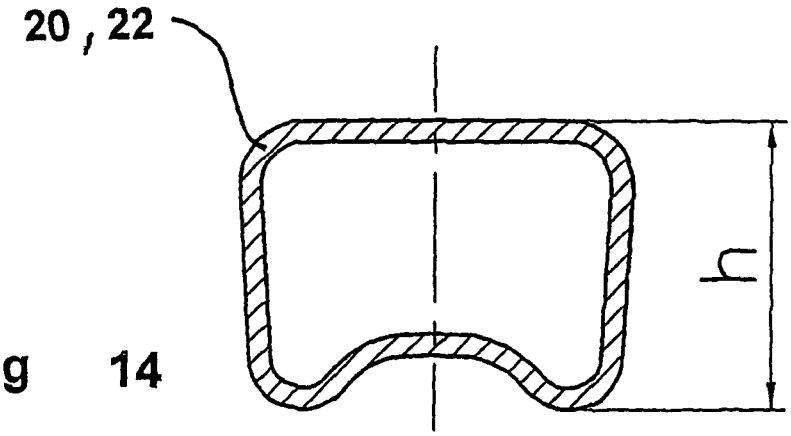
FIG. 14 is a cross section of a variation of a profiled tubular lattice rod outside the welded intersections (low tubular profile height)
Figure 15:
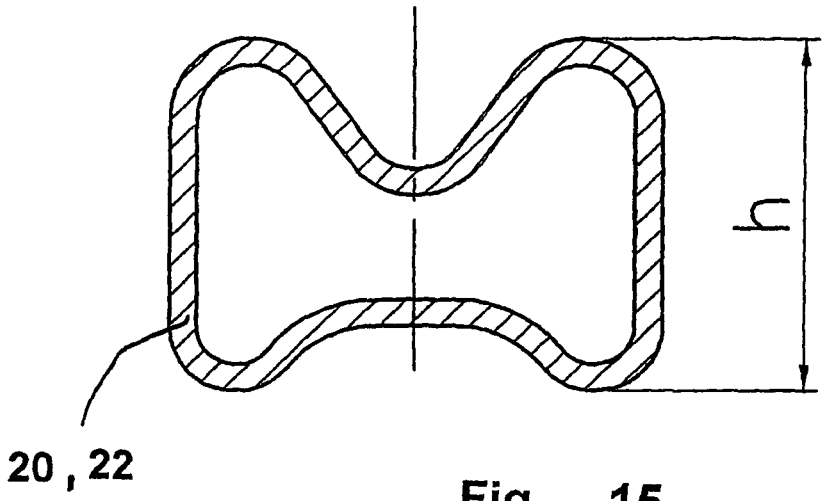
FIG. 15 is a cross section of a variation of a profiled tubular lattice rod outside the welded intersections (low tubular profile height)

FIG. 12 shows a cross sectional view through a profiled tubular lattice rod according to the invention to illustrate another currently preferred embodiment, with the high base profile having a trapezoidal tube profile at a welded intersection (great tubular profile height). The height "H" is hereby 16 mm and the width is about 18 mm. FIG. 13 shows the cross section through the profiled tubular lattice rod according to FIG. 12 outside the welded intersection with low tubular profile height "h". The height "h" is hereby 12 mm and the width is about 20 mm. The reduction of the tubular profile height from "H" to "h" is realized here from the broadside of the trapezoidal base profile. FIG. 14 depicts another cross sectional version of a profiled tubular lattice rod outside the welded intersection with low tubular profile height "h". The height "H" is hereby 12 mm and the width is about 19 mm. The reduction of the tubular profile height from "H" to "h" is realized here from the narrow side of the trapezoidal base profile; the profile approximates a rectangular configuration. Another version of a tube cross section reduced in height is shown in FIG. 15. The reduction of the tubular profile height H of the trapezoidal base profile is here also realized by shaping the narrow side inwards into the tube cross section, thereby establishing again a substantially rectangular profile.

Figure 16:
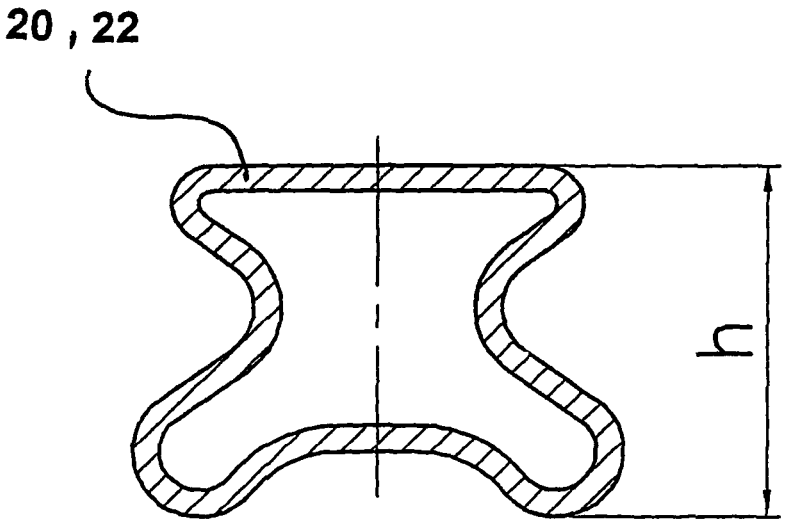
FIG. 16 is a cross section of another variation of a profiled tubular lattice rod outside the welded intersections (low tubular profile height)

A further version of a tube cross section reduced in height is illustrated in FIG. 16. The reduction of the tubular profile height H is here also realized by shaping both opposite slanted sidewalls of the trapezoidal base profile inwards into the tube cross section.

FIG. 17*a* shows a longitudinal section of tubular lattice rods 20, 22 at a welded intersection (great tubular profile height), while FIG. 17*b* is a cross section of a vertical tubular lattice rod 20 at a welded intersection (great tubular profile height), and FIG. 17*c* is a cross section of a vertical tubular lattice rod (small tubular profile height). The base profile H across the intersection is trapezoidal while the tubular rod profile h with reduced height between the intersections is rectangular. The reduction of the tubular profile height from "H" to "h" is realized respectively from the side of the horizontal and vertical tubular rods 20, 22 in opposition to the welding spots.

Figure 18:
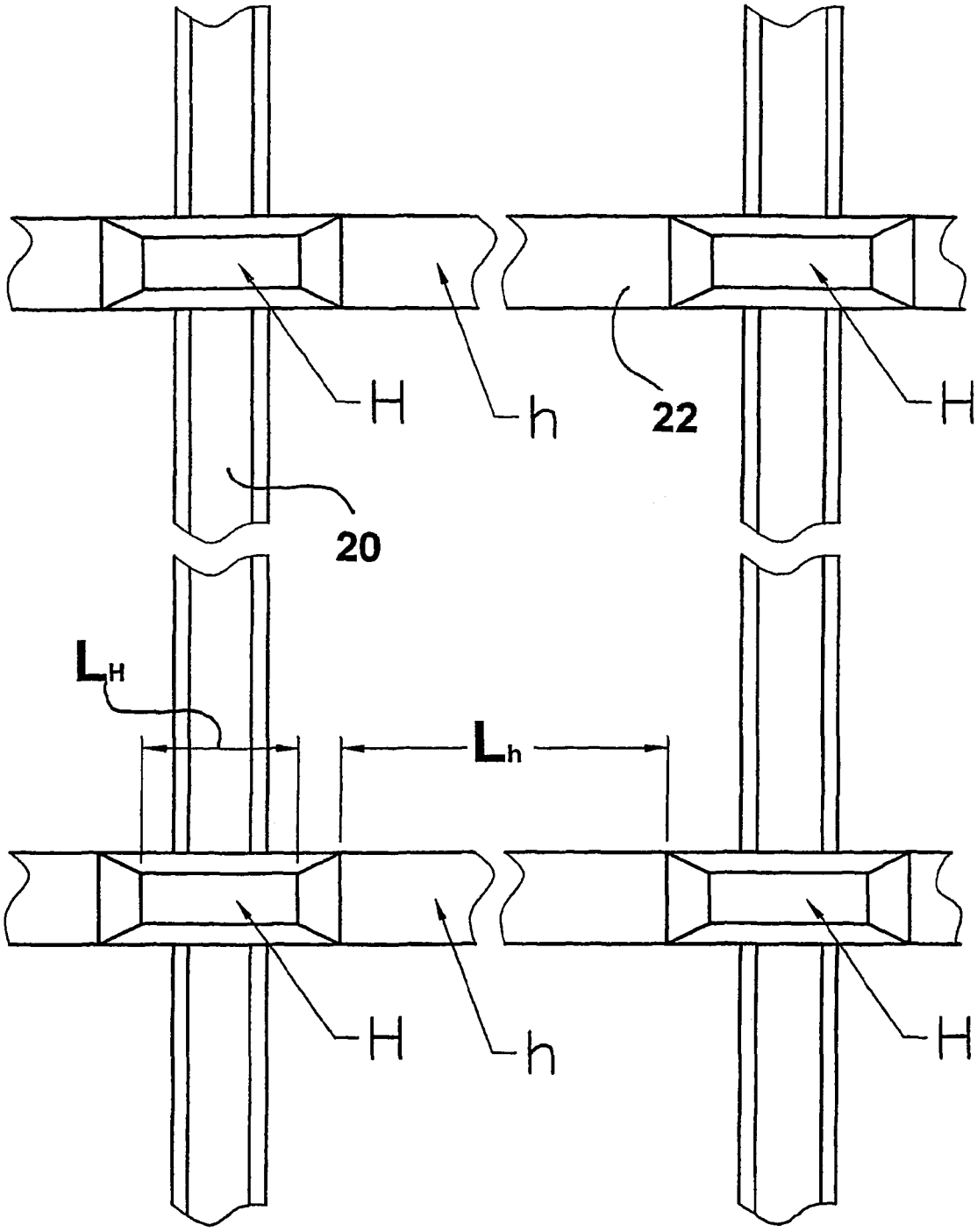
FIG. 18 is an outer view upon welded intersections of the lattice tube frame with profiled tube-lattice rods according to the invention.

FIG. 18 shows a cutaway plan view of a lattice frame from outside with four intersections. The horizontal tubular rods 22 and the vertical tubular rods 20 are welded to one another by means of four welding spots per intersection (via stacked intersecting outer ribs of the tubular lattice rods). The entire tubular rod is been flattened (or rolled down, compressed flat, shaped inwards) from the great tubular profile height H=base profile and amounts to between 100 mm to 260 mm, preferably about 130 mm. The comparably short tubular rod length $L_H$, extending across an intersection, with high tubular profile height H amounts to between 40 mm to 120 mm, preferably about 60 mm (=3×tubular rod width of 20 mm).

Figure 19:
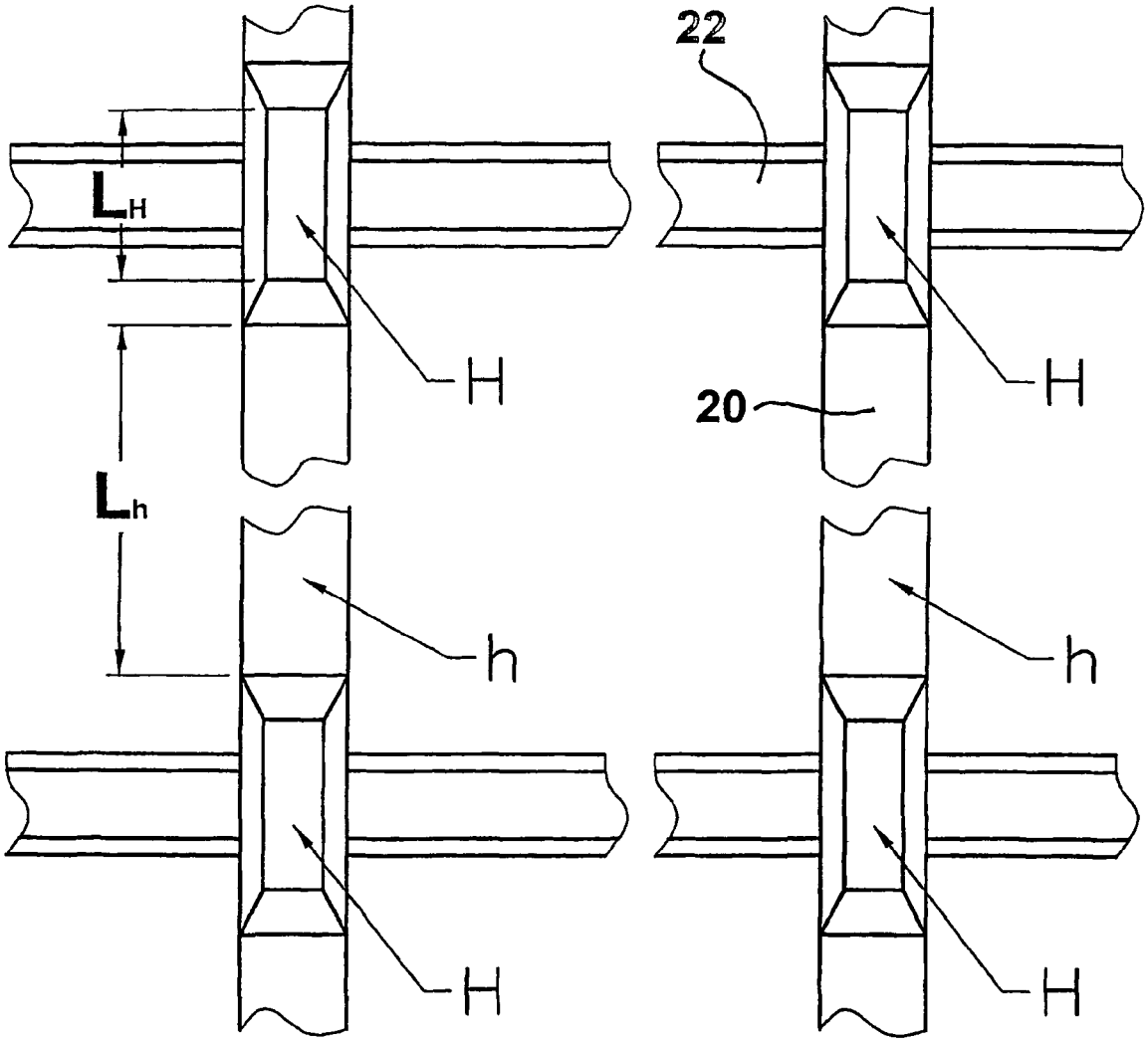
FIG. 19 is an inside view of the welded intersections of the lattice tube frame with profiled tube-lattice rods according to the invention.

FIG. 19 shows the respective view from inside (onto the elevations H of the vertical tubular rods 20).

In order to attain a high bending resistance in the area of the welded intersections while having a lower bending resistance or higher elasticity in the entire are of the lattice rods outside the intersections, various advantageous measures can be realized. On one hand, the horizontal tubular lattice rods 22 can be provided outside the intersections with a same or lower tubular profile height than the vertical tubular lattice rods 20 outside the intersections. On the other hand, the vertical tubular lattice rods 20 can be provided within the intersections with a same or higher tubular profile height than the horizontal tubular lattice rods 22. Furthermore, the horizontal or/and vertical tubular rods 20, 22 can extend within the intersection over a length $L_H$ of the respective tubular rod 20, 22 in longitudinal direction of the tubular rod from at least twice the tubular rod width (2×20 mm) up to a sixfold tubular rod width, preferably about threefold tubular rod width. Recommended for the lower rod profile (low tubular profile height)

of the horizontal or/and vertical tubular rods 20, 22 outside the intersections is a length Lh of the respective tubular rod 20, 22—in longitudinal direction of the tubular rod—from at least a threefold tubular rod width (3×20 mm) up to an eightfold tubular rod width, preferably about sixfold tubular rod width.

It is hereby advantageous for manufacturing reasons to provide regions of the lower tubular profile height h by lateral flattening (rolling in) both sides of the original profile rod with continuously high tubular profile height H.

Another possibility to reduce the tubular profile height H can be realized by flattening (rolling in) regions of two opposing sides of the original profile rod (base profile) on one side or/and on both sides.

These measures result individually or in advantageous combination to a significant improvement of the entire elasticity behavior of a lattice wall plane and relief of the regions of welded intersections and provide an appreciable decrease of the sensitivity to rod fracture (=fatigue fracture) when subjected to long-term and strong fluctuating bending stress like e.g. during extraordinary transport loads of filled pallet containers on trucks along poor roads.

The differences in the tubular profile height of the vertical or/and horizontal tubular lattice rods can be realized in accordance with the following variations:

1. different across the tubular lattice rod length,
2. solely on vertical tubular lattice rods,
3. on vertical and horizontal tubular lattice rods, or/and
4. solely realized in regions of the tubular lattice rods where required as a consequence of encountered load.

Figure 20:
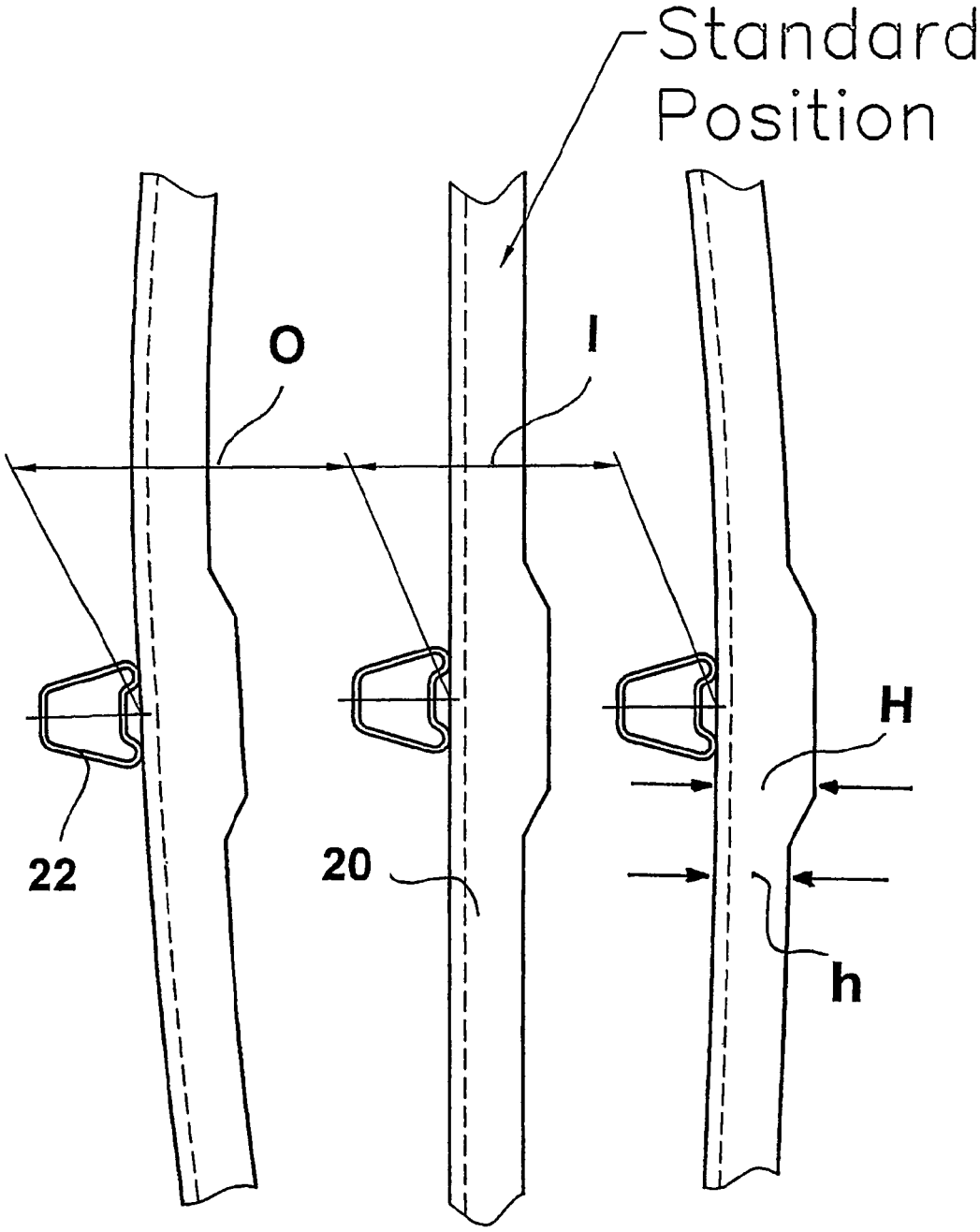
FIG. 20*a* is a schematic illustration of a vertical and horizontal tubular lattice rods at a welded intersection, depicting a normal elastic deformation of the vertical lattice rod caused by surge forces and stacking load.
FIG. 20*b* is a schematic illustration of a vertical and horizontal tubular lattice rods at a welded intersection, depicting a flexure to the outside of the vertical lattice rod caused by surge forces and stacking load.
FIG. 20*c* is a schematic illustration of vertical and horizontal tubular lattice rods at a welded intersection, depicting a flexure to the inside of the vertical lattice rod caused by surge forces and stacking load.

FIG. 20*a* depicts a preferred configuration of a vertical tubular rod 20 according to the invention in normal position. When subject to dynamic load, the vertical tubular rod 20 oscillates about this normal position and bends outwards according to FIG. 20*b* and inwards according to FIG. 20*c*.

Compared to known pallet containers, the configuration of the tubular rods according to the invention enables—in particular for the long sidewalls of the lattice frame, a greater amount "O" of the greatest elastic flexure to the outside and a greater amount "I" of the greatest elastic flexure to the inside, without encountering stress peaks of such high values that the vertical lattice rods which are strained predominantly experience fatigue cracks and brittle fracture in shortest time.

The lattice cage with its many "long" regions of low profile rod height thus results in a substantially more elastic spring system in comparison to known lattice cages of conventional pallet containers.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A pallet container, comprising:

a bottom pallet;

an inner container of thermoplastic material, placed on the bottom pallet, for storage and transport of liquid or free-flowing goods; and a lattice tube frame fixedly secured to the bottom pallet and disposed in surrounding relationship to the plastic container to form a support jacket, said lattice tube frame including vertical and horizontal tubular rods welded to one another at intersections, wherein at least the vertical tubular rods have regions of low tubular profile height and high tubular profile height, wherein the regions of low tubular profile height are uniformly linear and positioned outside the intersections, and the regions of high tubular profile height are positioned in an area of the intersections, wherein the vertical tubular rods are configured with two alternating cross sections of different configuration, with a first cross section having a low tubular profile height extending along a first rod length which extends a substantial distance between two adiacent, vertically spaced intersections, and a second cross section having a high tubular profile height which at least partially exceeds the low tubular profile height of the first cross section and extends continuously along a second rod length, which extends across the area of the intersections and is shorter than the first rod length, a first resistance moment against bending of the first cross section and a second resistance moment against bending of the second cross section which is greater than the first resistance moment against bending of the first cross section, and wherein the first rod length is at least twice as long as the second rod length.

2. The pallet container of claim 1, wherein the vertical and horizontal tubular rods have a low rectangular profile in the area outside the intersections and a high rectangular profile in the area across the intersections, wherein the horizontal tubular rods have a lower rod profile outside the intersections than the vertical tubular rods outside the intersections, and wherein the vertical tubular rods have a rod profile across the intersections which is greater than a rod profile of the horizontal tubular rods.

3. The pallet container of claim 1, wherein the first rod length is at least three times up to eight times a width thereof, and wherein the second rod length is in a range of at least twice to six times a width thereof.

4. The pallet container of claim 1, wherein the regions of the low tubular profile height of the vertical rods are formed by lateral flattening of both sides of a profile rod having a high tubular profile height from end to end.

5. The pallet container of claim 1, wherein the regions of the low tubular profile height of the vertical rods are formed on both sides by flattening two opposite sides of a profile rod having a high tubular profile height from end to end.

* * * * *